US006553903B2

(12) United States Patent
Hawkins

(10) Patent No.: US 6,553,903 B2
(45) Date of Patent: Apr. 29, 2003

(54) HYDRAULIC PRESS

(75) Inventor: Bobby L. Hawkins, Travelers Rest, SC (US)

(73) Assignee: Sunex International, Inc., Greenville, SC (US)

( * ) Notice: Subject to any disclaimer, the term of this patent is extended or adjusted under 35 U.S.C. 154(b) by 0 days.

(21) Appl. No.: 09/841,869

(22) Filed: Apr. 25, 2001

(65) Prior Publication Data

US 2002/0046661 A1 Apr. 25, 2002

Related U.S. Application Data

(60) Provisional application No. 60/200,422, filed on Apr. 28, 2000.

(51) Int. Cl.[7] ..... B30B 1/32

(52) U.S. Cl. ..... 100/269.17; 72/455; 100/257; 29/251

(58) Field of Search ..... 72/447, 455; 29/251; 100/214, 226, 247, 257, 269.17

(56) References Cited

U.S. PATENT DOCUMENTS

| | | | | |
|---|---|---|---|---|
| 2,439,725 A | * | 4/1948 | Frost | 100/269.17 |
| 3,283,699 A | * | 11/1966 | Hawkins | 100/269.17 |
| 3,495,527 A | * | 2/1970 | LaFreniere | 100/269.17 |
| 3,503,327 A | * | 3/1970 | Lenz | 100/269.17 |
| 4,283,825 A | | 8/1981 | McKay et al. | |

OTHER PUBLICATIONS

Sales Brochure—RAMCO 30 Ton Heavy Duty Press—RP30, published Mar. 20, 1999.
Sales Brochure—RAMCO 55 Ton Heavy Duty Press—RP55–2, published Mar. 20, 1999.
Sales Brochure—RAMCO 50 Ton Heavy Duty Press—RP50–2, published Mar. 20, 1999.
Sales Brochure—RAMCO 55 Ton Heavy Duty Press—RP55–AH, published Mar. 20, 1999.
OTC A–94 Catalog, pp. D–12 and D–13, published 1994.

* cited by examiner

*Primary Examiner*—W. Donald Bray
(74) *Attorney, Agent, or Firm*—Dority & Manning, P.A.

(57) ABSTRACT

An hydraulic press includes a head member removably connected at each opposite end to a leg and formed of a unitary sheet of steel rolled into a generally U-shaped transverse cross-section. The head member includes a reinforcing tube at its mid portion. The press includes a bed supported by the legs and disposed beneath the head member. The bed is reinforced at its mid portion by a pair of diagonally disposed spacer plates in the interior of the bed and at the exterior of the bed by a breast plate permanently attached to the front panel and a back plate permanently attached to the rear panel of the bed. At least one additional hole is provided and bored transversely through each end of the bed and positioned so as to correspond to and align with the holes in each leg that receive the pins that support the bed. The pressing force can be provided by an hydraulic jack that can be attached to the head member or to a carriage that is slidably disposed between the head member and the bed.

12 Claims, 7 Drawing Sheets

HYDRAULIC PRESS

This application claims the benefit of Provisional application Ser. No. 60/200,422, filed Apr. 28, 2000.

BACKGROUND OF THE INVENTION

Hydraulic presses rated for pressures up to 55 tons have been known. As shown in FIG. 1, these conventional presses include a pair of legs 11, 12 mounted on a pair of feet 13, 14 connected at the bottom by a cross brace 15. At the top of the legs, a head piece 16 is permanently connected (as by welding) to the two legs and provides the resistance for the hydraulic press. A bed 17 extends transversely across the legs and is positioned about midway between the head 16 and the feet 13, 14 and is carried by pins 18 that engage both the bed 17 and the legs 11, 12 at the opposite ends of the bed. The bed 17 carries the work piece to which the pressure is to be applied by the press. The bed 17 typically is reinforced at each opposite end of the bed 17 by a diagonally disposed spacer plate 19.

In a conventional press shown in FIG. 1 for example, each of the legs 11, 12, head piece 16, and bed 17 is formed of channel steel. The head 16 is formed by two lengths of channel steel 20 wherein each one is welded at each of its opposite ends to the upper end of each of the legs 11, 12. One length 20 is welded in the front of the press, and the other length 20 is welded in the back. Similarly, the bed 17 is formed by two lengths of channel steel 21 opposed to one another and joined at their opposite ends by welding the spacer plates 19 between them.

The gauge of the steel that is used depends upon the pressure rating of the press. For example, a conventional press rated at 55 tons typically would use 5 gauge channel steel for the legs 11,12, the lengths 21 forming the bed 17 and the lengths 20 forming the head 16. Conventional presses rated at 20 to 30 tons typically would use 9 gauge channel steel for the legs 11,12, the lengths 20 forming the head 16, and the lengths 21 forming the bed 17.

As shown in FIG. 1 for example, some conventional press designs have a carriage 22 that carries a hydraulic powered ram 24. As is conventional, the carriage 22 can be provided with one or more pairs of telescoping tubes 23 that guide the vertical movement of the carriage 22. In other designs such as shown in U.S. Pat. No. 4,283,825, which is hereby incorporated herein by this reference, the carriage 60 is guided by a pair of guide sleeves 63, 65, one being disposed at each opposite end of the carriage 60 and surrounding each leg.

The cost of shipping these conventional presses from the manufacturer to the customer depends on the volume occupied by the shipping carton and the weight of the press. Because the head 16 is welded to the legs and defines the overall width of the conventional press, the size of the shipping carton cannot be smaller than the width of the press. A conventional 55 ton press usually must be carried on a separate wooden pallet for each press. A shipping pallet holds about four conventional 30 ton presses or 20 ton presses, and about six conventional 12 ton presses usually can be shipped on a pallet. The shipping weight for a typical conventional press rated at 55 tons is about 480 pounds. Similarly, the shipping weights for a conventional 30 ton press is about 235 pounds, and 220 pounds for a conventional 20 ton press. A conventional 12 ton press has a shipping weight of about 80 pounds.

OBJECTS AND SUMMARY OF THE INVENTION

It is a principal object of the present invention to provide an hydraulic press that is lighter than conventional presses with the same pressure rating.

It is also a principal object of the present invention to provide an hydraulic press that has a more compact shipping volume than conventional presses with the same pressure rating.

It is a further principal object of the present invention to provide an hydraulic press that is less expensive to manufacture than conventional presses with the same pressure rating.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an hydraulic press includes a pair of spaced apart, vertically extending legs, a head member having each one of its opposite ends connected to the top end of one of the legs, a hydraulic cylinder having one end connected to the head, and a bed disposed transversely between the two legs and configured so that the operator can selectively slide the bed vertically along the length of the legs.

Each leg is formed of a length of C-channel steel in which the tab portions are drilled with spaced apart aligned holes along the lower half of each leg. A foot member is removably connected to the bottom end of each leg, and a cross-brace is removably connected to each foot member.

The head member has a transverse cross-sectional shape resembling the letter U and defines a base section and a pair of opposed side sections. Each side section is configured and disposed to extend at a right angle from the base section. The upper portion of each side section further defines a lip that is disposed in a plane that is parallel to the plane of the base section and perpendicular to the plane of each side section. The head member is desirably formed as a unitary sheet of steel that is rolled into the generally U-shaped transverse cross-sectional configuration with the lips on the upper portions of the side sections. Each end of the head member is removably attached to the upper portion of one of the legs. This typically is accomplished by one or more threaded bolts and threaded nuts extending transversely through pre-drilled holes that are aligned in the upper portions of the legs and the ends of the head member. A reinforcement channel is disposed to extend transversely on the interior surface of the base section of the head member and has its ends welded to the interior surfaces of the side sections.

The bed member includes a pair of lengths of C-channel steel that are disposed in opposition to one another to form a front panel and a back panel. The upper and lower tabs of the C-channel are disposed to face away from the tabs on the opposed length of C-channel. These panels are permanently connected by a pair of spacer plates disposed symmetrically between the mid-portions of the front and back panels. A front breast plate is permanently attached to the front panel of the bed. A rear plate is permanently attached to the back panel of the bed. At the opposite ends of the front and back panels of the bed, at least one pair of aligned holes is configured to receive a press pin therein. When the bed is mounted on the press, a press pin is received within each pair of aligned holes defined in each end of the front and back panels of the bed and extending through a pair of aligned corresponding holes defined in the tab portions of each leg. A handle is permanently attached to each end of the bed.

In an alternative embodiment of the press, a carriage member is disposed slidably between the opposed legs and oriented between the bed member and the head member. A pair of springs connects and biases the carriage to the head member. A means of guiding the carriage in vertical travel between the head member and the bed can also be provided and can take any of a number of forms that are conventional in the art.

The press of the present invention can be completely disassembled for packing in a shipping carton. Since the head is removably attached to the legs by one or more bolts at each end of the head section and upper portion of the legs, the width of the shipping carton is not defined by the width of the assembled press of the present invention. The disassembled press of the present invention occupies a much smaller volume than a fully assembled conventional press. Moreover, the gauge of steel that is required for the components of the press of the present invention is lighter than the gauge of steel that is used in a comparably rated conventional press. Accordingly, the press of the present invention is lighter in weight and occupies less shipping space than a comparably rated conventional press. Additionally, the use of bolts to connect the head member to the legs means that the press of the present invention is easier and less costly to build than a comparably rated conventional press.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 4:
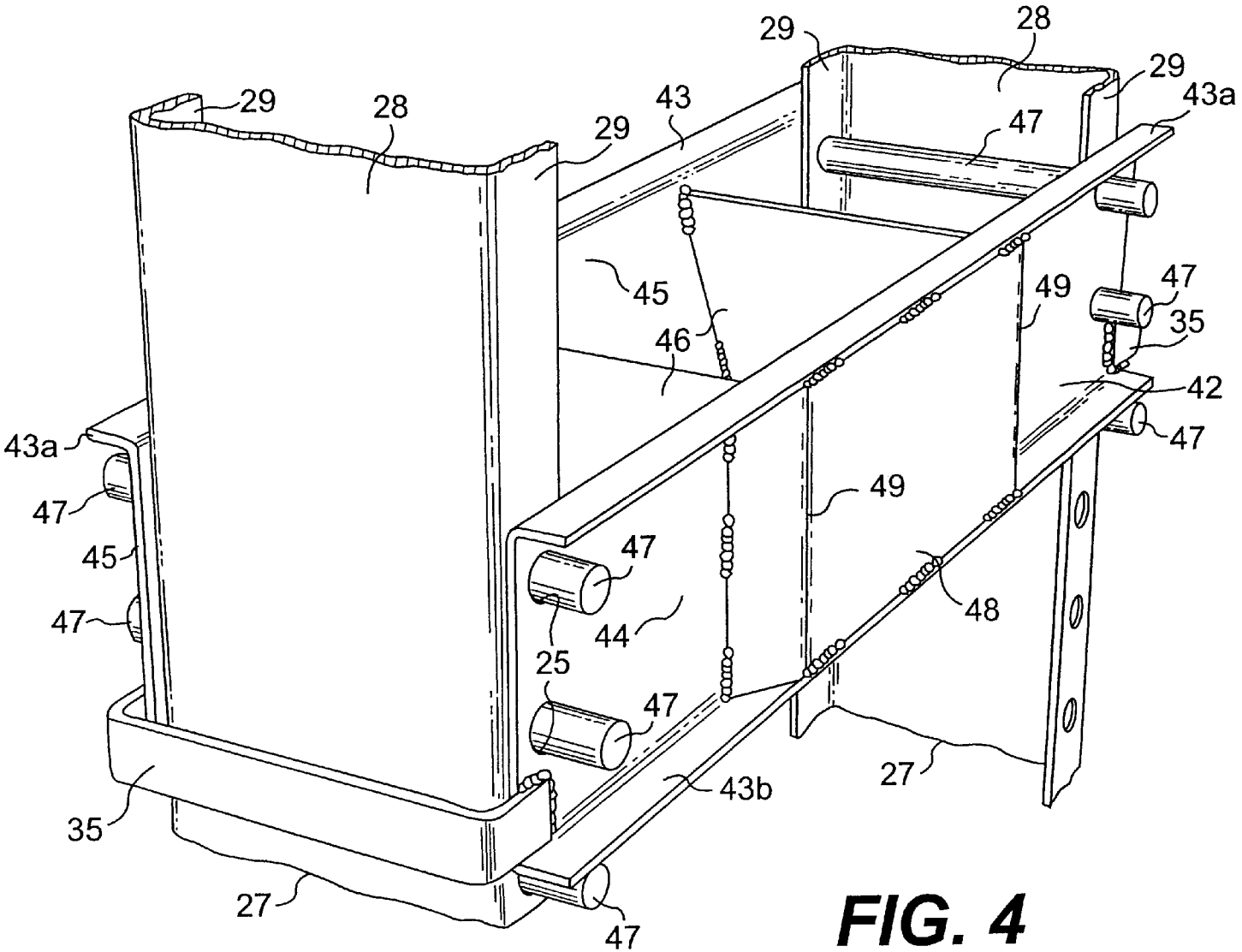
FIG. 4 is a partially cut away perspective view of a portion of the press shown in FIG. 2.

An hydraulic press configured in accordance with the present invention includes a pair of vertically extending legs that are disposed spaced apart from each other, and each leg has a top end and a bottom end. As embodied herein and shown in FIGS. 2 and 5 for example, each leg 27 is formed by a length of C-channel steel. As shown in FIG. 4 for example, each leg 27 has a flat mid portion 28 and a pair of tabs 29 extending from the top and bottom edges and unitary with the mid portion 28. The tabs 29 are disposed at a right angle with respect to the mid-portion 28. The tabs 29 of each leg 27 cooperate with the mid portion 28 to form and define three sides of a channel along the length of each leg. Each leg 27 is desirably disposed with the channel formed by the tabs 29 facing the channel of the opposed leg in the pair. Thus, the tabs 29 of each leg 27 point towards the tabs 29 of the opposed leg 27.

Figure 1:
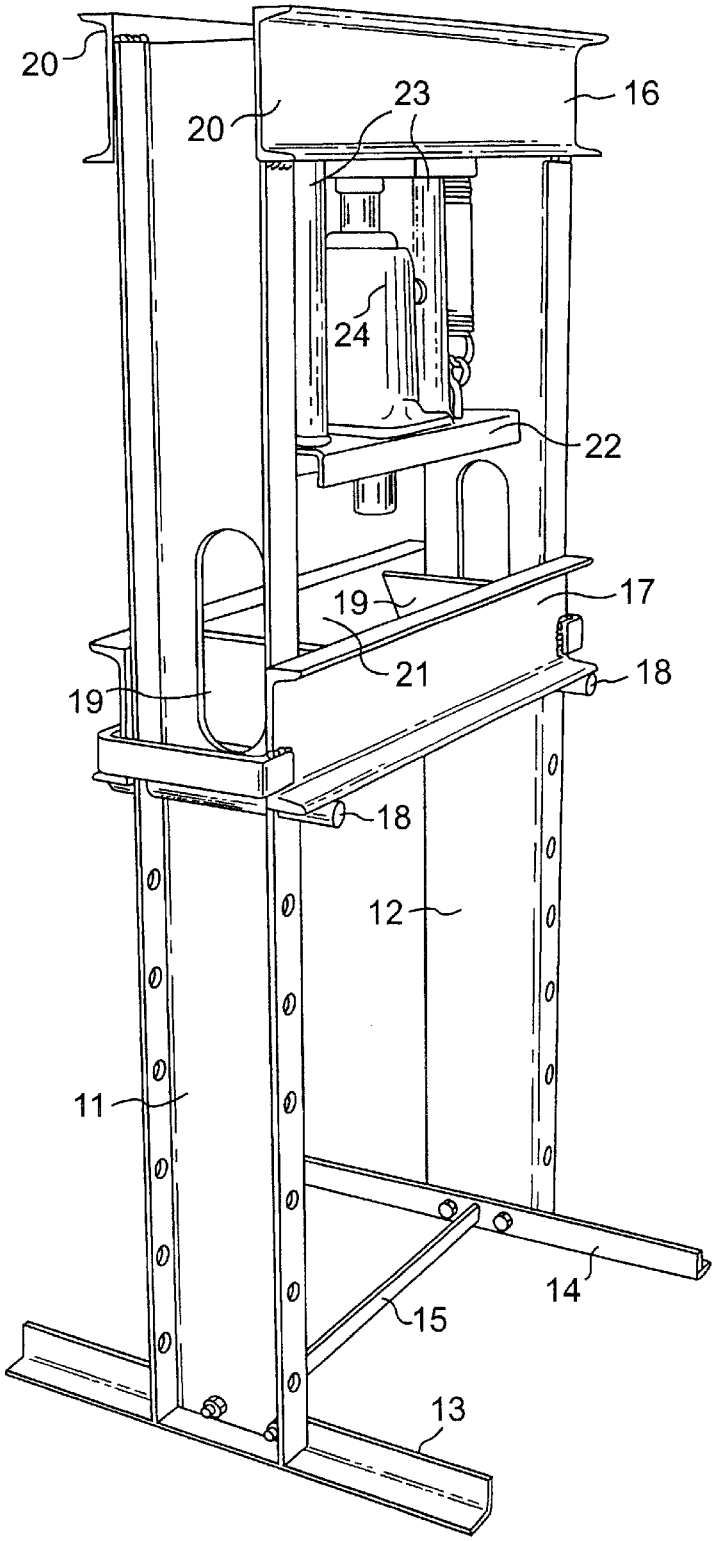
FIG. 1 PRIOR ART
FIG. 1 is an elevated perspective view of a conventional press.
Figure 2:
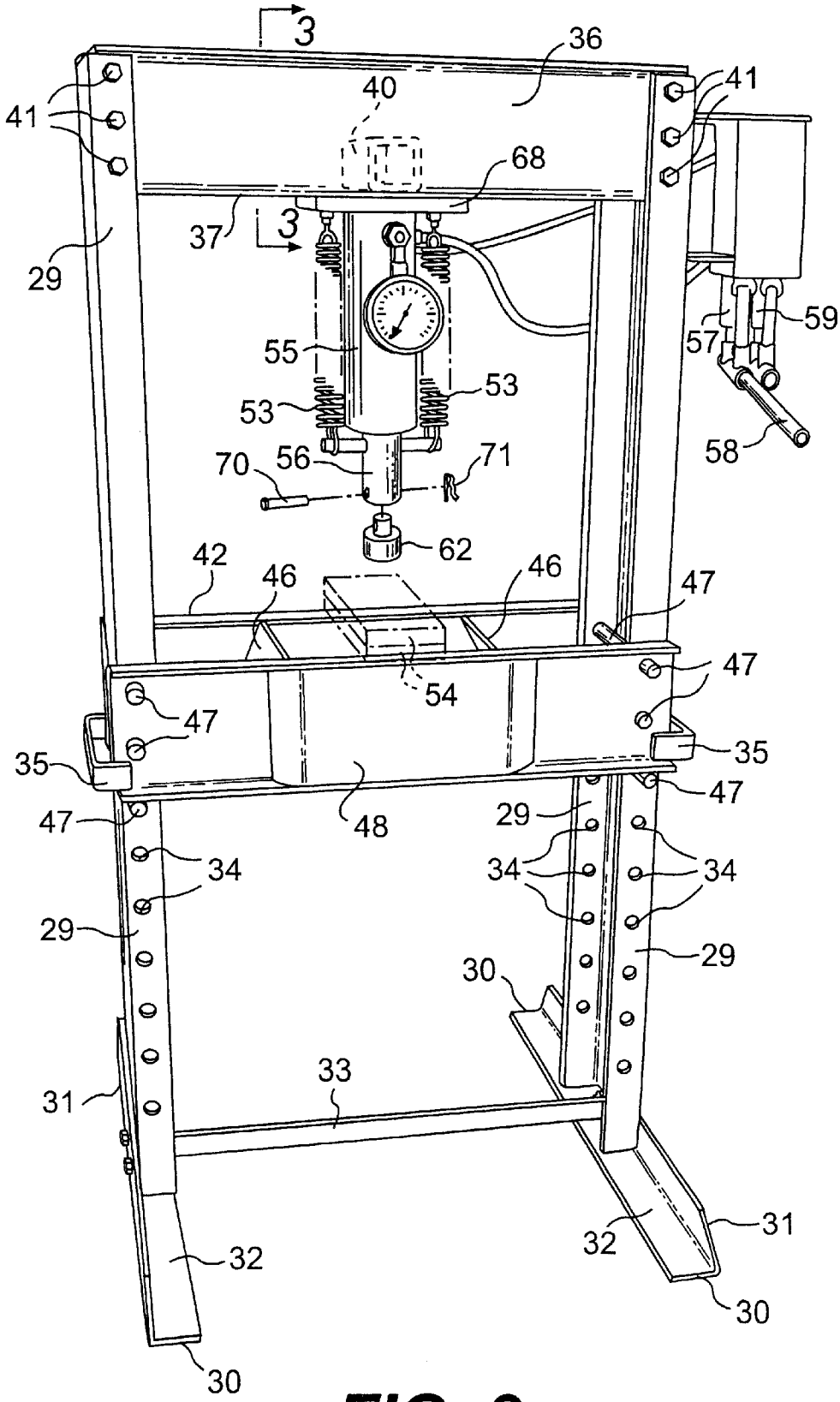
FIG. 2 is an elevated perspective view of a hydraulic press according to a presently preferred embodiment of the invention.
Figure 5:
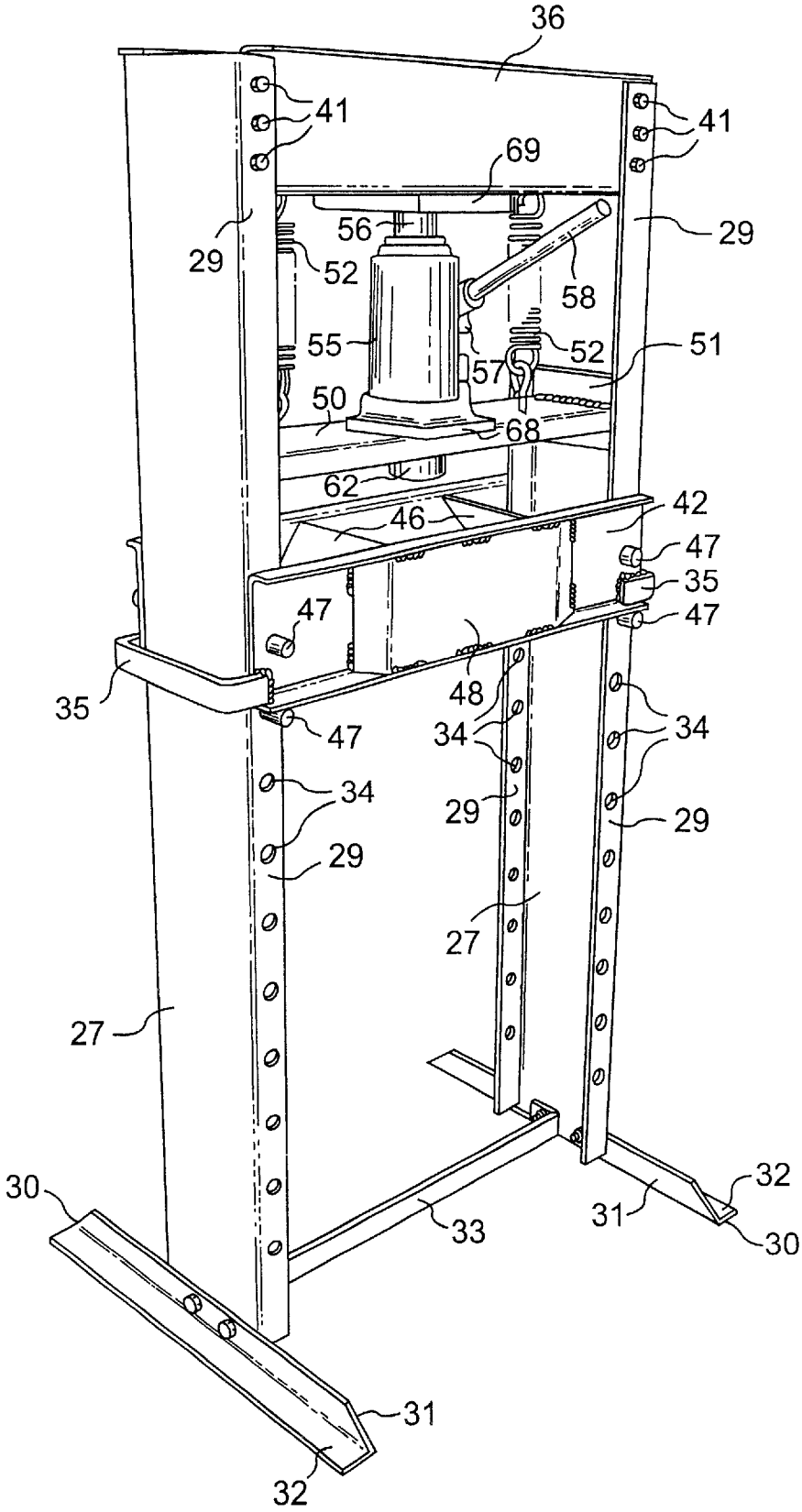
FIG. 5 is an elevated perspective view of an alternative presently preferred embodiment of the invention.

As shown in FIGS. 2 and 5 for example, a foot member 30 is removably connected to the lower end of each leg 27 as by being bolted thereto so as to extend at a right angle to the length of each leg. Each foot member 30 desirably is formed as a length of right angle steel that defines a pair of flanges 31, 32 joined at a right angle as a unitary length of steel. One of the flanges 31 is removably attached to one leg 27 of the press. As shown in FIGS. 2 and 5 for example, each end of a cross-brace 33 is removably connected to one of the foot members 30.

As shown in FIG. 2 for example, the foot member 30 can desirably be disposed so that the second flange 32, which is the one that contacts the floor, faces toward the center of the press. However, as shown in FIG. 5 for example, the foot member 30 can be disposed and attached to the leg 27 of the press so that the second flange 32 of the foot member 27 points away from the center of the press, if desired. This second orientation provides a wider footprint and arguably more stability to the press. At some locations, however, the wider footprint is undesirable, and unnecessary in view of the adequate stability of the press with the second leg 32 disposed toward the center of the press.

As shown in FIGS. 2 and 5 for example, each leg 27 has a plurality of holes 34 extending transversely therethrough and disposed along the length of the tabs 29 in the lower portion of the leg. The holes 34 are spaced apart and bored transversely with respect to the length of each leg. The holes 34 defined by one tab 29 of a leg 27 are aligned with holes 34 defined by the opposite tab 29 of the leg. Moreover, each hole 34 defined by each leg 27 is bored so as to correspond to a hole 34 defined by the opposite leg at the same distance from the end of the leg. Thus, when the legs 27 are connected to form the press, the aligned holes 34 of one leg 27 will be disposed at the same vertical height as the aligned holes 34 of the opposite leg 27.

The press includes a head member that is removably connected at each opposite end to one of the legs. As shown in FIGS. 2, 3, 5 and 7 for example, the press includes a head member 36 that is formed of a unitary plate of metal that is bent (as by being rolled) to form a U-shaped transverse cross-section. The head member 36 has a base 37 that is connected to each of a pair of opposed side portions 38 by a rolled portion of the plate such that the base 37 of the head member 36 extends in a plane that is perpendicular to the plane in which each of the side portions 38 extends. Moreover, the upper portion of each side portion 38 is also rolled to form a lip member 39 that is disposed in a plane that is parallel to the plane of the base 37 and perpendicular to the plane of the side portions 38.

Figure 3:
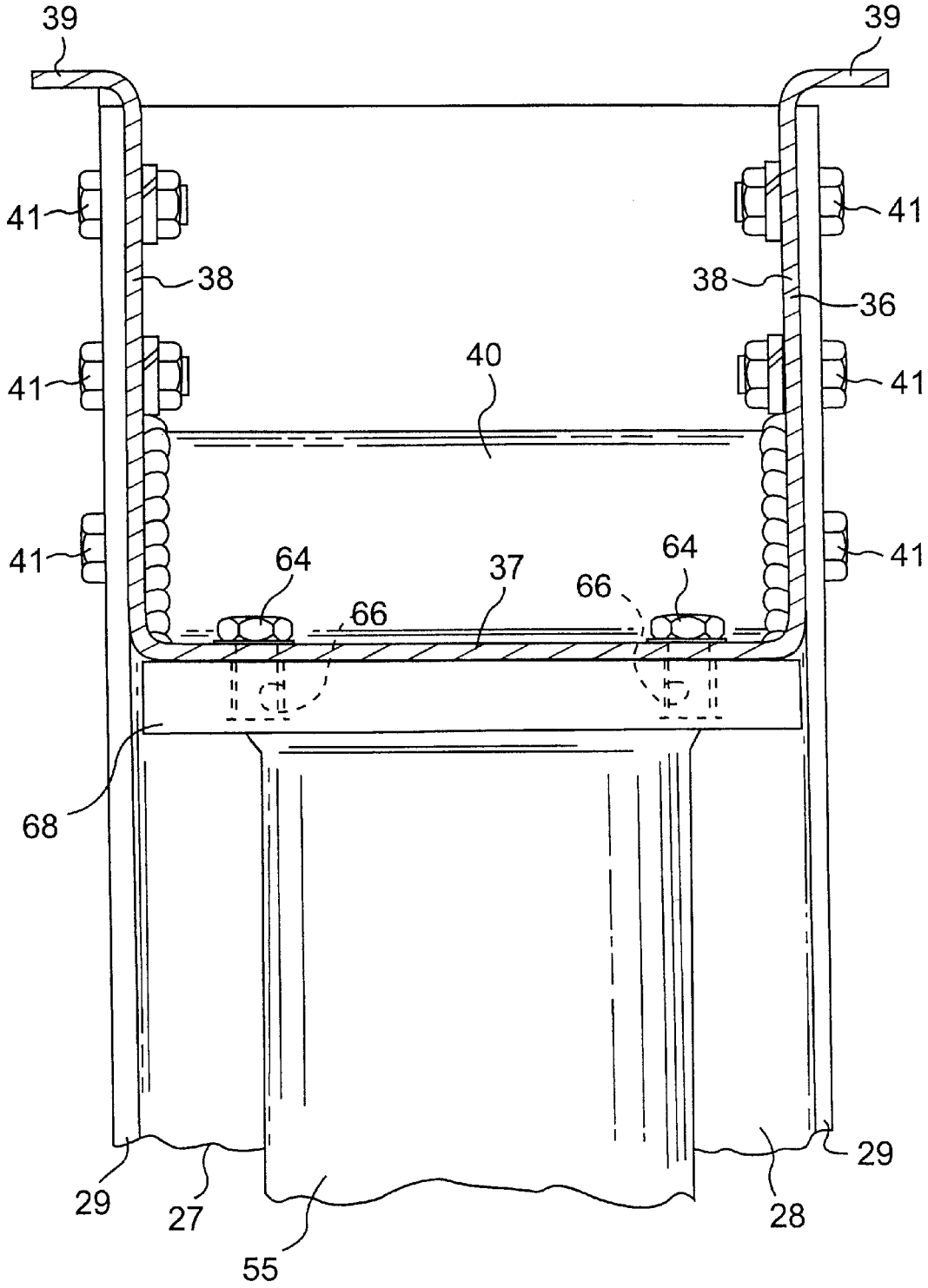
FIG. 3 is a view of components of the press taken in cross-section along the lines 3—3 in FIG. 2.

As shown in FIG. 3 for example, head member 36 is configured so that its opposite ends fit within the opposed channels formed by the legs 27, and the transverse width of the head member 36 is desirably configured to fit snugly within the channel formed by each leg 27. Accordingly, the head 36 can be inserted from the upper end of each leg 27 into the channels formed by the legs 27. The lip members 39 of each side portion 38 of the head 36 prevent the head member 36 from sliding past the upper free edge of each leg 27 toward the foot members 30 and are also believed to add strength to the head member 36.

As shown in FIGS. 2 (dashed line) and 3 for example, a reinforcing tube 40 can be connected to the base section 37 of head member 36. Desirably, this connection is permanent and can be accomplished by welding. As shown in FIG. 3 for example, reinforcing tube 40 extends transversely across head member 36 and is attached to the side portions 38 of head member 36.

As shown in FIGS. 2, 3 and 5 for example, the opposite ends of the head member 36 are removably secured to the legs 27. The opposite ends of the head 36 are drilled with one or more holes. The upper end of each leg 27 is drilled with one or more holes sized and spaced to correspond and align with the holes drilled through the ends of head member 36. The opposite ends of the head 36 are removably attached to the upper ends of the legs 27 by being bolted to the upper ends of the legs. Desirably ½" diameter grade 5 plated steel bolts are used for this purpose, and about two bolts at each end, front and back, are sufficient for a press rated for twelve tons. In the embodiments shown in FIGS. 2, 3 and 5 for example, three bolts 41 and corresponding nuts connect each end of each side of the head member 36 to the upper portion of one of the tab portions 29 of each leg 27 for presses rated at twenty tons and higher.

It is believed that the configuration of the head member 36 with the rolled lips 39, the reinforcing tube 40 and attachment to the legs 27 by bolts 41 rather than welding results in a stronger head member 36 and permits the press to operate at greater loads than conventional presses with thinner gauge steel in the head member than conventional presses of comparable pressure capacity.

The press of the present invention includes a bed that is supported by the legs and disposed beneath the head member. The bed extends parallel to the head member and transversely with respect to the length of the legs and provides the support for the work piece that is to be subjected to the pressure applied by the press.

As embodied herein and shown in FIGS. 2, 4 and 5 for example, the bed 42 is desirably formed by two lengths of steel C-channel arranged in opposition to one another with the channel portions facing away from one another. Thus, as shown in FIG. 4 for example, the tabs 43*a*, 43*b* of one of the lengths of C-channel are disposed to face away from the tabs 43*a*, 43*b* on the opposed length of C-channel. One length of C-channel forms a front panel 44 of the bed 42, and the opposed length of C-channel forms the rear panel 45 of the bed 42.

The bed is reinforced at its mid portion by a pair of diagonally disposed spacer plates in the interior of the bed. As embodied herein and shown in FIGS. 2, 4 and 5 for example, the bed 42 is provided with a pair of symmetrically placed spacer plates 46 that extend between the interior surfaces of the front panel 44 and rear panel 45 of the bed 42. These spacer plates 46 are disposed in the mid-portion of the bed 42 and extend at an angle (typically 45 degrees) from the horizontal as the bed is positioned between the legs 27. Thus, the front and rear panels of the bed 42 are joined permanently (as by welding) at their mid portions by the spacer plates 46 between them. Disposing the spacer plates 46 near the mid portion of the bed 42 rather than towards the ends of the bed, is believed to allow the bed to be constructed of thinner gauge steel than conventional presses of comparable pressure rating. As shown in FIG. 4 for example, a handle 35 can be permanently attached (as by welding) to each end of the bed.

Figure 6:
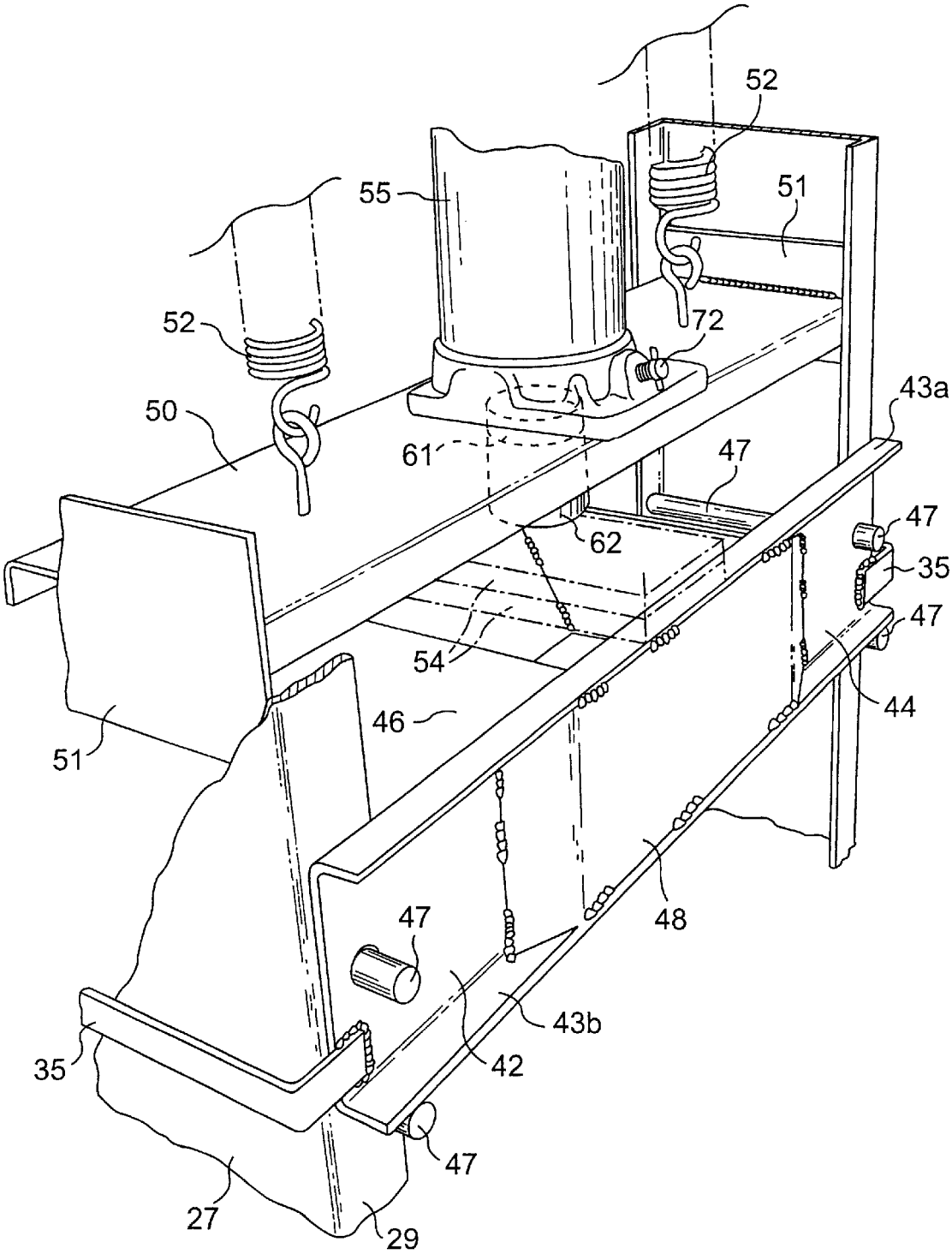
FIG. 6 is a partially cut away perspective view of a portion of the press shown in FIG. 5.

As noted above and shown in FIGS. 2, 4 and 6 for example, each hole 34 in the lower half of each leg 27 is configured to receive therein a steel pin 47 that can extend sufficiently out of each hole so as to provide a resting place for the bottom surface of the bed 42, which is held at a particular height above the floor by the pins 47. As shown in FIGS. 4 and 6 for example, the bottom surfaces of tabs 43*b* define the bottom surface of bed 42 that is carried by pins 47, which are in turn carried by the legs 27 via the holes 34 through the tabs 29 of the legs 27.

However, the press of the present invention is configured to provide additional support and an additional margin of safety against failure during operation of the press. As embodied herein and shown in FIGS. 5, 6 and 7 for example, at least one additional hole 25 is provided and bored transversely through each end of the front and rear panels 44, 45 of bed 42 and positioned so as to correspond to and align with the holes 34 in each leg 27. Accordingly, as shown in FIGS. 2 and 4 for example, up to two additional pins 47 can be disposed transversely through the holes on each end of the bed 42 and through the corresponding holes 34 in the corresponding leg 27 at each end of the bed. These additional pins 47 provide additional support and an additional margin of safety against failure of any one pin disposed beneath bed 42 during operation of the press.

The bed is reinforced at its mid portion at the exterior of the bed by a breast plate permanently attached to the exterior of the front panel and a back plate permanently attached to the exterior of the rear panel of the bed. As embodied herein and shown in FIGS. 2, 4, 5 and 6 for example, the bed 42 can be provided with a breast plate 48 that is permanently attached (as by welding) in the vicinity of the mid-portion of the bed to the front of the front panel 44 of the bed. As shown in FIGS. 4 and 6 for example, one lateral edge of the breast plate 48 is disposed to extend from and connect to the free edge of upper tab 43*a* and the other lateral edge of the breast plate 48 is disposed to extend from and connect to the free edge of lower tab 43*b* of the front panel 44 of the bed 42. As shown in FIGS. 4 and 6 for example, the ends of the breast plate 48 are permanently attached to the front panel 44.

A back plate 26 (FIG. 7 only) is similarly connected to the rear panel 45 of the bed 42 and oriented symmetrically about the mid-portion of the rear panel 45 to coincide with the location of the breast plate 48. Each lateral edge of the back plate is also disposed to extend from and connect to one of the free edge of the upper tab and the free edge of the lower tab of the rear panel 45 of the bed 42. The ends of the back plate 26 are permanently attached to the rear panel 45. As shown in FIG. 4 for example, the breast plate 48 and the back plate are configured with a pair of bends 49 that trisect the plates and configure the plates in the shape of three sides of a trapezoid. It is believed that the configuration of the breast plate 48 and the back plate strengthens the bed 42 and permits the press to operate at greater loads with thinner gauge steel in the legs 27 and bed 42 than conventional presses of comparable pressure capacity.

For a 55 ton-rated press configured according to the present invention, the head member 36 is formed of 7 gauge steel rather than the 5 gauge steel that is required for the head of a conventional press rated at 55 tons. The legs 27 of a 55 ton-rated press configured according to the present invention are formed from 7 gauge steel rather than the 5 gauge steel that is required on a conventional press that is rated for 55 tons. The front and rear panels 44, 45 of the bed 42 and the breast plate 48 and the back plate 26 of a 55 ton-rated press configured according to the present invention are also formed of 7 gauge steel rather than the 5 gauge steel that is required on the bed of a conventional 55 ton press. Similarly, in a 30-ton or 20-ton press according to the present invention, 9 gauge steel is used for the above-listed components instead of the 7 gauge steel that is used for the same components in a conventional 30-ton or 20-ton press for example. Additionally, in a 12-ton press according to the present invention, 11 gauge steel is used for the above-listed components instead of the 9 gauge steel that is used for the same components in a conventional 12-ton press for example.

Figure 7:
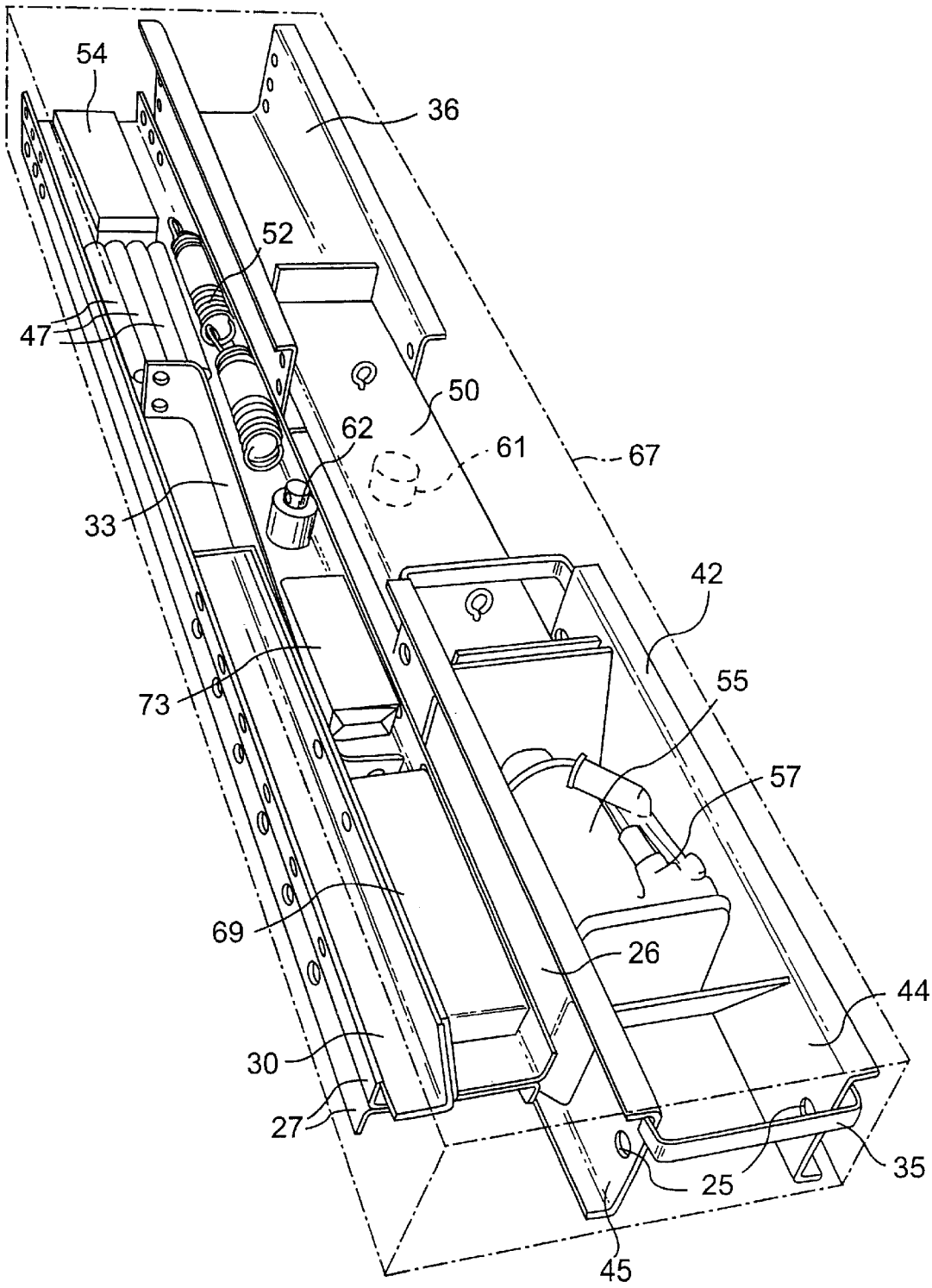
FIG. 7 is an elevated perspective view of a presently preferred embodiment of the press in its disassembled form and organized in a manner that fits into a shipping carton (indicated by chain dashed lines).

As shown in FIGS. 5, 6 and 7 for example, in one alternative embodiment of the press of the present invention, a carriage member 50 is provided. Carriage member 50 is configured and disposed to be vertically moveable between the legs 27. As shown in FIG. 6 for example, a guide member in the form of a slide plate 51 is disposed at a right angle at each opposite end of the carriage 50 and configured to fit slidably within the channel formed by each leg 27. The slide plates 51 at the opposite ends of the carriage 50 function to prevent tilting of the carriage 50 that might position the carriage 50 at an orientation other than perpendicular with respect to the legs 27 and parallel with respect to the head member 36 and bed 42. As is conventional in the art, alternative types of guide members can be provided in the form of a pair of telescoping tubes wherein one end of one tube is connected to the head member 36 and one end of the other tube is connected to the carriage member 50. Desirably a second guide element in the form of two additional telescoping tubes are connected between the head 36 and the carriage member 50 and disposed symmetrically with respect to the first guide element.

As is conventional, an hydraulic cylinder is provided to supply the force needed to operate the press. The hydraulic cylinder is disposed so as to apply pressure to the head member and the bed during operation of the press. The hydraulic cylinder can have one end disposed in contact with the head member by being attached to the head member or resting against a pressure plate that presses against the head member. In the latter case, the base of the hydraulic cylinder can rest on a carriage that is slidably disposed between the head member and the bed.

As embodied herein and shown in FIGS. 2 and 5 for example, the hydraulic cylinder 55 can be provided in the form of a hydraulic jack that has a pump 57 operated by a manual actuating handle 58 and a release valve that is operated by a spigot 72 (FIG. 6). As shown in FIG. 2 for example, the hydraulic cylinder 55 can be connected to the head member 36 and configured and disposed to position the ram 56 to operate directly on a work piece that is carried by the bed 42. As shown in FIG. 3 for example, shouldered bolts 64 can be passed through holes in the base 37 of head member 36 and screwed into tapped holes 66 (outlined in dashed line) provided in the base plate 68 of the hydraulic cylinder 55. Alternatively, as shown in FIG. 5 for example, the hydraulic cylinder 55 can be disposed between the head member 36 and the carriage member 50 so that the ram 56 is disposed in contact with a pressure plate 69 that rests against the head member 36, and the base plate 68 of the cylinder 55 rests against carriage member 50.

As is conventional, a mechanism for biasing the ram 56 of the cylinder 55 towards the head member can be provided. As shown in FIG. 2 for example, this can be accomplished by a pair of springs 53 that have one end connected to the head member 36 and the other end connected to the ram 56 of the cylinder 55. Similarly, in the embodiment shown in FIGS. 5 and 6 for example, a mechanism for biasing the carriage member 50 towards the head member can be provided. As shown in FIG. 5 for example, this can be accomplished by a pair of springs 52 connected between the head member 36 and the carriage member 50. In each embodiment, the respective springs 52, 53 act to force hydraulic fluid back into the reservoir so that the ram 56 can retract into the cylinder 55 when the cylinder=s pressure valve is opened.

A mechanism can be provided so that the press can be fitted with a tool element. As shown in FIG. 2 for example, the free end of the ram 56 can be configured to hold the tool element 62 in any conventional manner such as by a bolt 70 and pin 71. In this way, the end of the ram 56 can be configured to hold a tool element 62 that is removably attachable to ram 56. However, as shown in FIG. 6 for example, a chuck 61 or a collet 61 or another implement configured to hold a tool element 62 to depend downwardly therefrom or presented in a desired position for performing the desired work function, can be provided. The chuck 61 can be attached to the underside of the carriage as shown in FIG. 6. Both arrangements of the hydraulic press are conventional and are not further described herein.

As shown in FIG. 2 for example, cylinder 55 can be configured with a second pump 59 that receives one end of the handle 58 in a manner that permits the user to apply pressure to the cylinder 55 in a manner that operates the ram 56 to extend at a greater rate than the conventional pump 57 of the cylinder 55.

As shown in FIGS. 2 and 6, a pair of flat bars 54 (depicted in dashed lines) can be provided to raise the height of the work piece and dispose it closer to the end of the working tool 62 of the press.

As shown in FIG. 7 for example, the press of the present invention disassembles for shipping in a carton 67 (indicated by the chain dashed lines). The legs 27 can be disposed lengthwise in the carton together with the foot members 30 likewise. The head member 36, carriage 50 (if any), bed 42 and hydraulic cylinder 55 can be aligned in carton 67 alongside legs 27 and foot member 30. Various other smaller components such as flat bars 54, pins 47 cross brace 33, tool element 62, springs 52 and boxes 73 of the bolts and nuts used for assembly can be fitted into carton 67.

The press of the present invention can be completely disassembled for packing in a shipping carton. Since the head 36 is removably attached to the legs 27 by one or more bolts 41 at each end of the head section and upper portions of the legs, the width and depth of the shipping carton is not defined by the width and depth of the assembled press of the present invention. The disassembled press of the present invention occupies a much smaller volume than a fully assembled conventional press of comparable pressure rating. Accordingly, a single shipping pallet should be able to hold four 55-ton presses according to the present invention versus only one conventional 55-ton press. A single shipping pallet should be able to hold fifteen 30-ton presses according to the present invention versus only four conventional 30-ton presses. A single shipping pallet should be able to hold fifteen 20-ton presses according to the present invention versus only four conventional 20-ton presses. A single shipping pallet should be able to hold twenty 12-ton presses according to the present invention versus only six conventional 12-ton presses.

Moreover, the gauge of steel that is required for the components of the press of the present invention is lighter than the gauge of steel that is used in a conventional press that has a comparable pressure rating. Accordingly, the press of the present invention is lighter in weight and occupies less shipping space than a comparably rated conventional press. A 55-ton press according to the present invention weighs only about 380 pounds versus about 480 pounds for a conventional 55-ton press. A 30-ton press according to the present invention weighs only about 175 pounds versus about 235 pounds for a conventional 30-ton press. A 20-ton press according to the present invention weighs only about 145 pounds versus about 220 pounds for a conventional 20-ton press. A 12-ton press according to the present invention weighs only about 60 pounds versus about 80 pounds for a conventional 12-ton press.

Additionally, the use of bolts to connect the head member to the legs means that the press of the present invention is easier and less costly to build than a comparably rated conventional press.

While preferred embodiments of the invention have been described using specific terms, such description is for illustrative purposes only, and it is to be understood that changes and variations may be made without departing from the spirit or scope of the following claims.

What is claimed is:

1. A hydraulic press, comprising:

a pair of vertically extending legs, each leg having a top end and a bottom end, each leg being disposed spaced apart from the other leg;

a head defining a first end and a second end opposed to said first end, said first end being removably connected to the top end of one of said legs, said second end being removably connected to the top end of said other leg;

a bed disposed transversely between said two legs; and a hydraulic cylinder disposed so as to apply pressure to said head member and said bed during operation of the press.

2. A hydraulic press, comprising:

a pair of vertically extending legs, each leg having a top end and a bottom end, each leg being disposed spaced apart from the other leg;

a head defining a first end and a second end opposed to said first end, said first end being removably connected to the top end of one of said legs, said second end being removably connected to the top end of said other leg;

a bed disposed transversely between said two legs;

a hydraulic cylinder disposed so as to apply pressure to said head member and said bed during operation of the press; and wherein said head is formed as a unitary rolled sheet of steel configured in a generally U-shaped transverse cross-section and wherein each end of said head is removably connected to one of said legs by at least two nuts and bolts.

3. A hydraulic press, comprising:

a pair of vertically extending legs, each leg having a top end and a bottom end, each leg being disposed spaced apart from the other leg;

a head defining a first end and a second end opposed to said first end, said first end being removably connected to the top end of one of said legs, said second end being removably connected to the top end of said other leg;

a bed disposed transversely between said two legs;

a hydraulic cylinder disposed so as to apply pressure to said head member and said bed during operation of the press; and wherein said head defines a base and a pair of opposed side portions, each said side portion being configured and disposed to extend from said base and having an upper portion, said upper portion of each side portion further defining a lip member that is disposed in a plane that is parallel to the plane of said base and perpendicular to the plane of said side portion.

4. A press as in claim 3, further comprising:

a reinforcing tube permanently connected to said base section of said head.

5. A hydraulic press, comprising:

a pair of vertically extending legs, each leg having a top end and a bottom end, each leg being disposed spaced apart from the other leg;

a head defining a first end and a second end opposed to said first end, said first end being removably connected to the top end of one of said legs, said second end being removably connected to the top end of said other leg;

a bed disposed transversely between said two legs;

a hydraulic cylinder disposed so as to apply pressure to said head member and said bed during operation of the press; and wherein said bed includes a front panel and a back panel opposed to said front panel and a pair of spacer plates disposed symmetrically about the mid-portion of said bed and connected between said panels of said bed.

6. A hydraulic press, comprising:

a pair of vertically extending legs, each leg having a top end and a bottom end, each leg being disposed spaced apart from the other leg;

a head defining a first end and a second end opposed to said first end, said first end being removably connected to the top end of one of said legs, said second end being removably connected to the top end of said other leg;

a bed disposed transversely between said two legs;

a hydraulic cylinder disposed so as to apply pressure to said head member and said bed during operation of the press; and wherein said bed includes a front panel and a back panel opposed to said front panel and further comprises:

a breast plate permanently attached to said front panel of said bed; and a rear plate permanently attached to said back panel of said bed.

7. A press as in claim 1, wherein said bed includes a front panel and a back panel opposed to said front panel and each end of said front and back panels of said bed defines at least a first pair of aligned holes configured to receive a first press pin therein and defines a second pair of aligned holes configured to receive a second press pin therein.

8. A press as in claim 7, wherein each said leg includes a first pair of aligned holes therethrough and the press further comprises:

a first press pin received within each first pair of aligned holes defined in each end of said front and back panels of said bed and extending through said first pair of aligned holes defined through each said leg.

9. A press as in claim 8, further comprising:

at least a second pair of aligned holes defined through each end of said front and back panels of said bed and configured to receive a second press pin therein;

a second pair of aligned holes defined through each said leg and configured to receive a second press pin therein; and a second press pin received within each second pair of aligned holes defined in each end of said front and back panels of said bed and extending through one of said second pairs of aligned holes defined through each said leg.

10. A hydraulic press, comprising:

a pair of vertically extending legs, each leg having a top end and a bottom end, each leg being disposed spaced apart from said other leg, and each said leg including at least one pair of aligned holes therethrough;

a head member defining a first end and a second end opposed to said first end, said first end of said head member being removably connected to said top end of one of said legs by at least two nuts and bolts, said second end of said head member being removably connected to said top end of said other leg by at least two nuts and bolts, said head member being formed as a unitary rolled sheet of steel configured in a generally U-shaped transverse cross-section and wherein said head member defines a base and a pair of opposed side portions, each said side portion being configured and disposed to extend from said base and having an upper portion, said upper portion of each said side portion further defining a lip member that is disposed in a plane that is parallel to the plane of said base;

a reinforcing channel permanently connected to said base of said head member and extending between said opposed side portions of said head member and having a first end connected to one of said opposed side portions of said head member and having a second end disposed opposite said first end and connected to the other of said opposed side portions of said head member;

a bed disposed transversely between said two legs wherein said bed includes a front panel and a back panel opposed to said front panel and a pair of spacer plates disposed symmetrically about the mid-portion of said bed and connected between said panels of said bed, each of said front panel and back panel includes a first end and a second end disposed opposite said first end, and each end of said front and back panels of said bed defines at least one pair of aligned holes configured to receive a press pin therein;

a breast plate permanently attached to said front panel of said bed;

a rear plate permanently attached to said back panel of said bed;

a press pin received within each pair of aligned holes defined in each end of said front and back panels of said bed and extending through one of said pairs of aligned holes defined through each said leg; and a hydraulic cylinder disposed between said head member and said bed so to provide the pressing force of the press.

11. A press as in claim 10, further comprising:

a first foot member removably connected to said bottom end of one of said legs, and a second foot member removably connected to said bottom end of a second one of said legs, each said foot member being configured as an elongated length of right angle steel defining a pair of flanges joined at a right angle, wherein one of said flanges is disposed to rest against one of said legs and the other of said flanges is disposed to rest against a surface that is supporting the weight of the press.

12. A press as in claim 10, further comprising:

at least a second pair of aligned holes defined through each end of said front and back panels of said bed and configured to receive a press pin therein;

a second pair of aligned holes defined through each said leg and configured to receive a press pin therein: and a press pin received within each said second pair of aligned holes defined in each end of said front and back panels of said bed and extending through one of said second pairs of aligned holes defined through each said leg.

* * * * *